US007861787B2

(12) United States Patent
Russell

(10) Patent No.: US 7,861,787 B2
(45) Date of Patent: Jan. 4, 2011

(54) WELLBORE FLUID TREATMENT TUBULAR AND METHOD

(75) Inventor: Thane Geoffrey Russell, Cochrane (CA)

(73) Assignee: Absolute Completion Technologies Ltd., Calgary (CA)

( * ) Notice: Subject to any disclaimer, the term of this patent is extended or adjusted under 35 U.S.C. 154(b) by 0 days.

(21) Appl. No.: 12/206,613

(22) Filed: Sep. 8, 2008

(65) Prior Publication Data

US 2009/0065206 A1 Mar. 12, 2009

Related U.S. Application Data

(60) Provisional application No. 60/970,481, filed on Sep. 6, 2007.

(51) Int. Cl.
*E21B 43/16* (2006.01)
*E21B 17/18* (2006.01)

(52) U.S. Cl. ..... 166/310; 166/169; 166/242.5; 166/371

(58) Field of Classification Search ..... None
See application file for complete search history.

(56) References Cited

U.S. PATENT DOCUMENTS

| | | | | |
|---|---|---|---|---|
| 1,256,830 | A | | 2/1918 | Rodrigo, Sr. |
| 1,473,644 | A | | 11/1923 | Rodrigo, Sr. |
| 1,488,753 | A | | 4/1924 | Kelly |
| 1,750,871 | A | | 3/1930 | Wilson |
| 2,391,609 | A | | 12/1945 | Wright |
| 2,401,035 | A | | 5/1946 | Akeyson et al. |
| 2,540,123 | A | | 2/1951 | Kinley |
| 2,798,768 | A | | 7/1957 | Babin |
| 3,177,945 | A | | 4/1965 | Fether |
| 3,213,950 | A | | 10/1965 | Ghelfi et al. |
| 3,273,641 | A | | 9/1966 | Bourne |
| 3,299,831 | A | | 1/1967 | Watson et al. |
| 3,322,199 | A | | 5/1967 | Van Note, Jr. |
| 4,706,751 | A | * | 11/1987 | Gondouin ..... 166/401 |
| 5,310,000 | A | | 5/1994 | Arterbury et al. |
| 5,526,881 | A | | 6/1996 | Martin et al. |
| 5,551,513 | A | | 9/1996 | Surles et al. |
| 5,816,742 | A | | 10/1998 | Cordewener |
| 6,012,522 | A | | 1/2000 | Donnelly et al. |
| 6,561,732 | B1 | | 5/2003 | Bloomfield et al. |

(Continued)

FOREIGN PATENT DOCUMENTS

| | | |
|---|---|---|
| BG | 31730 | 3/1982 |

(Continued)

OTHER PUBLICATIONS

Introduction to STARS Screens, Absolute Engineering Inc., presented prior to Dec. 10, 2003.

*Primary Examiner*—Zakiya W. Bates
(74) *Attorney, Agent, or Firm*—Bennett Jones LLP

(57) ABSTRACT

A wellbore tubular including: an inner tubular wall; an opening through the inner tubular wall; an outer tubular wall positioned about the inner tubular, the outer tubular wall including an opening therethrough; a chamber between the inner tubular wall and the outer tubular wall; and a chemical treatment material in the chamber and positioned between the opening of the inner tubular wall and the opening of the outer tubular wall. The wellbore tubular may be used in downhole fluid treatment process.

39 Claims, 3 Drawing Sheets

U.S. PATENT DOCUMENTS

| | | | | |
|---|---|---|---|---|
| 6,702,044 | B2 | 3/2004 | Reddy et al. | |
| 7,258,166 | B2 | 8/2007 | Russell | |
| 2001/0042620 | A1 | 11/2001 | Ohanesian | |
| 2002/0020527 | A1 | 2/2002 | Kilaas et al. | |
| 2004/0084186 | A1* | 5/2004 | Allison | 166/305.1 |
| 2004/0231845 | A1 | 11/2004 | Cooke, Jr. | |
| 2005/0056425 | A1 | 3/2005 | Grigsby et al. | |
| 2006/0011345 | A1 | 1/2006 | Delaloye et al. | |
| 2007/0246212 | A1 | 10/2007 | Richards | |
| 2007/0256834 | A1 | 11/2007 | Hopkins et al. | |
| 2008/0006402 | A1 | 1/2008 | Russell | |

FOREIGN PATENT DOCUMENTS

| | | | |
|---|---|---|---|
| CA | 2255071 | | 6/1999 |
| DE | 1301300 | | 8/1969 |
| DE | 10031663 | | 8/2001 |
| EP | 1416118 | A1 | 5/2004 |
| FR | 2906561 | A1 | 4/2008 |

* cited by examiner

WELLBORE FLUID TREATMENT TUBULAR AND METHOD

FIELD

The invention relates to wellbore tubulars and, in particular, wellbore tubulars for wellbore fluid treatments.

BACKGROUND

Various wellbore tubulars are known and serve various purposes. A wellbore screen is a tubular including a screen material forming or mounted in the tubular wall. The wellbore screen can be used in wellbores such as those for water, steam injection and/or petroleum product production.

In one form, a wellbore screen is known that includes a wall of screen material held between end fittings. The wall includes screen material that may take various forms and is usually supported in some way, as by a perforated sleeve. These screens filter fluids passing through the screen material layer either into or out of the screen inner diameter.

In another form, a wellbore screen is an apparatus that can include a base pipe and a plurality of filter cartridges supported in the base pipe. The filter cartridges are mounted in openings through the base pipe wall. The filter cartridges screen fluids passing through the openings into the base pipe for pumping or flow up hole. Of course, the openings may be formed and/or employed to also permit flow of fluids outwardly therethrough from the inner diameter of the base pipe.

In situ treatment of produced fluids are of interest as they may take advantage of useful downhole conditions, facilitate fluid handling and avoid disposal of problematic materials at surface. Other downhole fluid treatments may also be of interest, for example, to address problems experienced when injected fluids downhole.

SUMMARY

In accordance with one aspect of the present invention, there is provided a wellbore tubular comprising: a perforated wall including an inner tubular wall, an opening through the inner tubular wall, an outer tubular wall positioned about the inner tubular wall, an opening through the outer tubular wall, and a chamber between the inner tubular wall and the outer tubular wall; and a chemical treatment material in the chamber and positioned between the opening of the inner tubular wall and the opening of the outer tubular wall.

In accordance with another aspect of the present invention, there is provided a method for treatment of a fluid in a well, the method comprising: providing a wellbore tubular including a fluid passage through a wall thereof and carrying a chemical treatment material in the fluid passage; running the wellbore tubular into the wellbore; allowing a flow of a fluid through the fluid passage and into active contact with the chemical treatment material, such that the fluid is chemically treated by the chemical treatment material.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
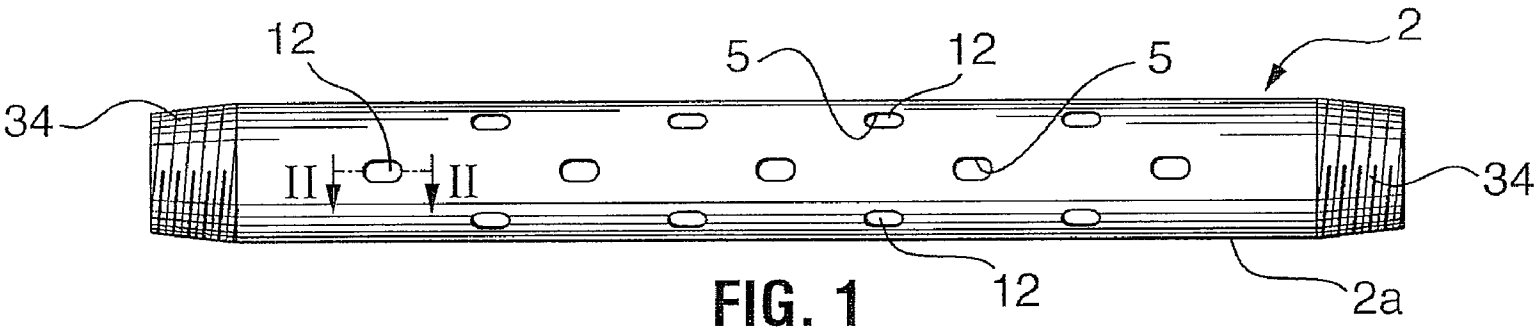
FIG. 1 is a side elevation of a wellbore tubular.
Figure 3:
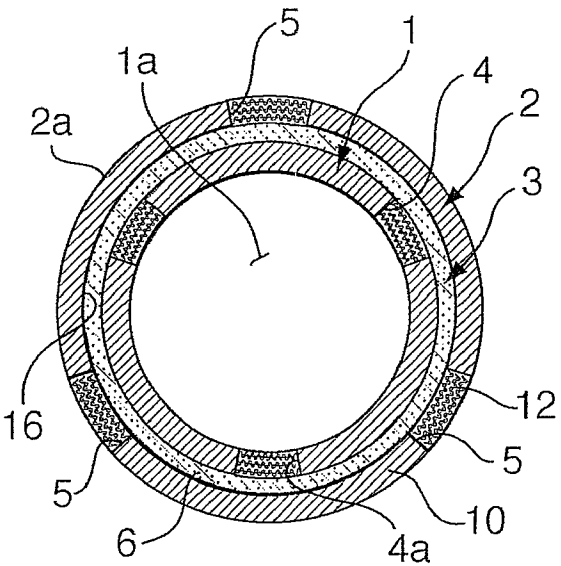
FIG. 3 is a section along line I-I of FIG. 2.
Figure 2:
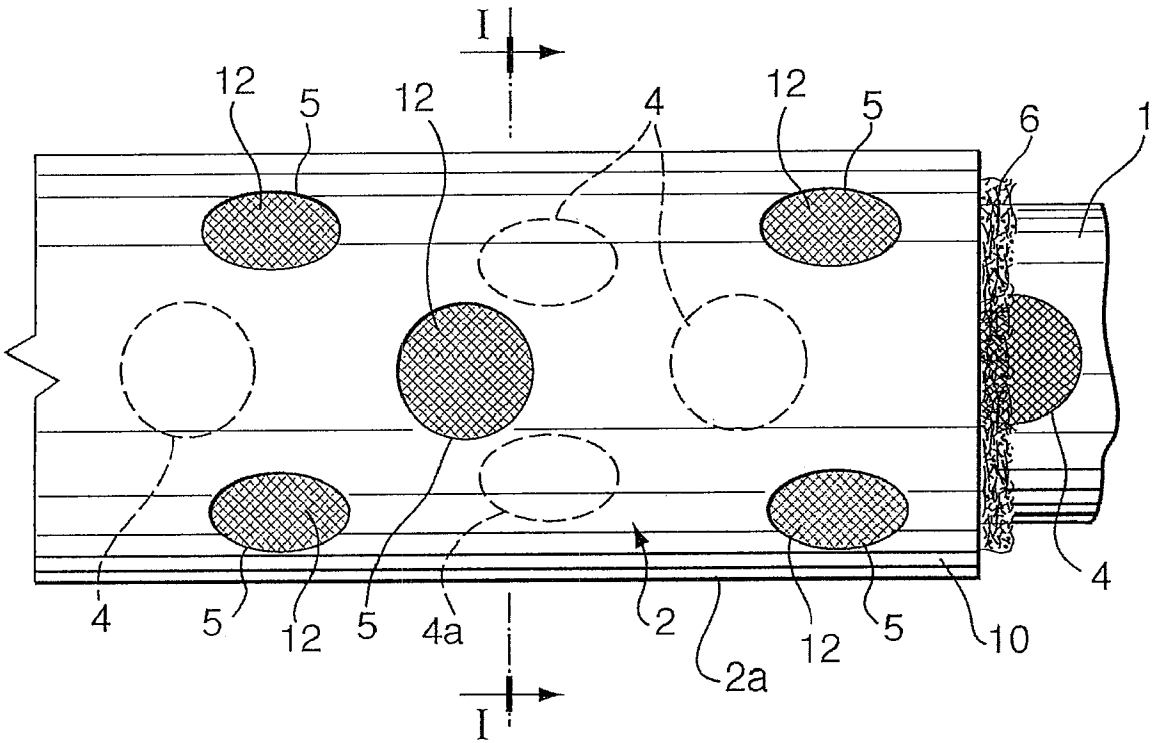
FIG. 2 is an enlarged side, cutaway view of the wellbore screen of FIG. 1.

Referring to FIGS. 1 to 3, a wellbore tubular is shown including a perforated wall with fluid passages therethrough. The perforated wall may be formed using various constructions. In the illustrated embodiment, the perforated wall includes a two layer construction formed by an inner tubular wall 1 and an outer tubular wall 2, which have a gap therebetween forming a chamber 3. The inner diameter of inner tubular wall 1 creates the inner diameter 1*a* of the wellbore tubular and the outer surface 2*a* of outer tubular wall 2 creates the outer surface of the wellbore tubular. The perforated wall may be formed in various ways. In one embodiment, the tubular walls 1, 2 are separate tubulars connected together by any of various means such as by welding, fusing, forming, crimping, etc. The tubular walls may be connected at their ends and/or by intermediate spacers. The way in which the tubular walls are connected may define the shape of chamber 3. For example, in one embodiment as shown, outer tubular wall 2 may be mounted concentrically over, and secured and sealed at its ends about, inner tubular 1 such that chamber 3 is defined as an annular, cylindrical-shaped gap between the tubular walls spanning a length along the wellbore tubular.

The ends 34 of the wellbore tubular may be formed for connection to adjacent wellbore tubulars. As will be appreciated, the tubular's ends may be formed in various ways for connection into a string, such as, for example, by formation at one or both ends as threaded pins (as shown), threaded boxes or other types of connections Inner diameter 1*a* extends from end to end of the tubular such that the tubular can act to convey fluids from end to end therethrough and be used to form a fluid conduit through a plurality of connected tubulars.

The perforations of the tubular's perforated walls are formed by openings formed through the inner tubular wall and the outer tubular wall. In particular, walls 1, 2 each have openings 4, 5, respectively, therethrough to permit fluid flow therethrough and through chamber 3 therebetween. Annular chamber 3 may be an enclosed chamber between the tubular walls such that any fluid flow passing therethrough arises by flow through openings 4 or 5. Depending on the mode of operation intended for the wellbore tubular, fluid flow can be inwardly toward inner diameter 1*a* (i.e. from one or more openings 5 through chamber 3 and then through one or more openings 4) or outwardly from inner diameter 1*a* (i.e. arising from inner diameter 1*a*, through one or more openings 4 into chamber 3 and out through one or more openings 5).

Openings 4, 5 through the tubular walls can be positioned to direct flow in selected ways through the perforated wall of the wellbore tubular. In one embodiment, at least one selected opening 4*a* of tubular wall 1 is offset both axially and radially from any opening 5 through tubular wall 2. In such a configuration, fluid flow into or out of the wellbore tubular cannot flow directly radially from opening 4*a* to opening 5. Instead fluid is forced to have residence time in chamber 3, wherein fluid is forced to flow axially and/or circumferentially along the chamber to pass between opening 4*a* and opening 5. In one embodiment, the plurality of openings, 4, 4*a* formed through tubular wall 1 are offset both axially and radially from any openings 5 through tubular wall 2 such that any fluid passing into or out of the wellbore tubular must pass axially and/or circumferentially with residence time through chamber 3.

The chamber 3 contains chemical treatment materials 6 such that fluids passing therethrough are chemically treated. Chemical treatment materials 6 can be used to chemically modify, for example improve, the fluid. The modification may be to reduce, as by capturing, eliminating, inactivating, etc., adverse components of the fluid including one or more of heavy metals, sulfur-containing compounds, carbon dioxides, water, plug causing materials (i.e. wax, asphaltenes, bacteria, etc.) or to otherwise improve the fluid's characteristics, such as its viscosity, API gravity, etc. For example, the chemical treatment materials may include any or all of a catalyst, an adsorbent, an absorbent, a solubilizable chemical, a chemically active material such as a reactive metal or magnet, etc. Such chemical treatment materials may include for example, one or more of petroleum refining materials, gas treatments such as sweeteners, desiccants, de-waxing agents or deodorizers, materials for chemically treating water, etc. The chemical treatment materials may be selected to operate in downhole conditions, for example with consideration to conditions such as heat, pressure, the presence of water, aerobic/anaerobic conditions, etc.

In one embodiment, for example, the tubular may be selected to provide in situ, partial refining of produced fluids. In such an embodiment, the tubular may accommodate a chemical treatment material that acts to partially refine fluids passing therethrough, such as produced fluids passing into the tubular to be conveyed to surface. For example, the chemical treatment materials may operate to at least partially upgrade the produced fluids, such as heavier oils, to produce higher quality hydrocarbons with, for example, lower viscosity, increased API gravity, and lower metal and/or sulfur concentrations. The chemical treatment materials may, for example, provide cracking as by hydrogenation, carbon rejection or carbon concentration and removal, as by use of catalysts, etc. In one embodiment, for example, a petrochemical upgrading catalyst may be positioned in chamber 3 of a tubular to catalyze an upgrading reaction. Many petrochemical upgrading catalysts are known such as, for example, those including one or more of hydrotreating catalyst, CoMo or CoMo/Al catalysts, elements useful for catalytic effects (Rd, Pt, Pd, Cr, rare earths, etc.) and/or zeolite, gravel or other substrates, etc. These petrochemical upgrading catalysts can be selected to withstand, and possibly be enhanced by, downhole conditions, such as the elevated temperatures and pressures generated by in situ production such as by steam-assisted, vapor-assisted or combustion processes.

In another example, the wellbore tubular may be selected to provide in situ gas treatment such as one or more of sweetening, desiccation, dewaxing and/or deodorization. In such an embodiment, the tubular may accommodate a chemical treatment material that treats gasses, such as produced petrochemical gasses (i.e. natural gas, methane, shale gas, etc.), passing into the tubular to be conveyed to surface. The petrochemical gas treatment materials may include one or more of a desiccant, a sweetener such as one to remove H2S and/or CO2, a dewaxing agent, a deodorizer, a molecular sieve for example silica gel, activated carbon, zeolite, lime, etc., a catalyst for example iron sponge material, an absorbent, a device generating a magnetic or otherwise reactive field, etc.

In yet another embodiment, the wellbore tubular may be selected to facilitate downhole fluid production or injection processes such as those for water. In such an embodiment, chamber 3 of the tubular may accommodate a chemical treatment material for purification, biocontrol and/or deodorization such that water passing through the tubular's wall chamber is suitably treated. For example, in one embodiment, bacterial growth can create problematic plugging in production or injection wells and the tubular can carry a biocide such as a bacteriocide active against the problematic bacteria. For example, bacteriocides are known such as slow release chemical pesticides. In another example, bacteriocides are known that are based on reactive metals such as those relating to the use of brass.

Again, these chemical treatment materials should be selected with consideration to the downhole conditions in which the tubular is to be employed.

In one embodiment, the wellbore tubular is formed as a screen. In the illustrated embodiment, for example, tubulars walls 1, 2 each include filter media installed in their openings. Chamber 3 may also, or alternately, accommodate filter media. The filter media and chemical treatment materials allow the tubular to act both as a screen against passage of oversize materials such as sand and to chemically treat the fluids passing therethrough. In addition to screening oversize materials, the filter media may also act to retain the chemical treatment materials, preventing them from being dislodged or carried by the fluid passing therethrough. In addition or alternately, the filter media may act as a support on which the chemical treatment materials can be placed and/or the filter materials may directly act to provide chemical treatment, such as where the filter materials include active metals such as brass.

Since it may be difficult or expensive to run tubular strings into and out of a wellbore, it may be useful to consider the activity of the chemical treatment material with respect to the volume of fluid that can be treated by it and/or the material's active life.

In one embodiment, the total volume of fluid to be treated by the wellbore tubular may be considered and sufficient material 6 provided in the tubular to treat that volume of fluid. For example, in some in situ combustion processes for heavy oil, the total volume of produced fluid that will pass through the tubular along any length thereof may be estimated. In such a process, an amount of petrochemical upgrading catalyst at least sufficient to treat that total volume of produced fluid may be loaded into the tubular during manufacture thereof before the tubular is run into the well.

In another embodiment, a chemical treatment material may be used that can be periodically reactivated. Reactivation processes are known for some adsorbents, absorbents, catalysts, molecular sieves, etc. For example, reactivation processes employing one or more of pressure change, heat, chemical flushing, gas purging, electromagnetic treatment, etc. can be used to regenerate the activity of some chemical treatment materials. Such regeneration processes may be carried out by introducing fluids or tools or by modifying downhole conditions from surface, while the tubular remains in place in the well.

Of course, a wellbore tubular can be employed that includes an amount of material 6 that does not remain active for the full operational life of the wellbore tubular. In such a case, when it is determined that the chemical treatment materials are spent and no longer actively treating the wellbore fluids, it may be decided that the tubular will be left in place and the fluids passing therethrough will simply no longer be chemically treated or, alternately, the tubular may be tripped to surface for recharging or replacement or the tubular may be supplemented by installation of a new tubular in the fluid path with active materials 6 therein.

Regardless of the form of chemical treatment material employed, it is installed in the screen in such a way that fluid passing through the screen is actually treated by it. The fluid must pass in active contact with the chemical treatment material, which may require that the fluid come into direct contact with it or close enough to be treated by the material, for example, as in the case of a material operable to treat by a generated magnetic field. In one embodiment, the chemical treatment material 6 does not fill the entire chamber but is positioned between openings 4 of the inner tubular wall and openings 5 of the outer tubular wall such that fluid passing between those openings can come into active contact with it. In another embodiment, chamber 3 may be filled with the chemical treatment material 6. Flow diverters may be installed in the annular chamber to direct the flow into active contact with material 6.

As noted, the fluid passage openings through the tubular walls may be offset, to force fluid to pass axially and/or circumferentially through chamber 3, to ensure a residence time therein. For some chemical treatments of fluids, a particular residence time may be required. To provide an adequate residence time, openings 4 through the inner tubular wall may be spaced a selected distance from openings 5 through the outer tubular wall, with consideration as to the expected flow rate of the fluid being handled. For example, where only a short residence time is required, the openings of the inner tubular wall may be nearly radially aligned with the openings of the outer tubular wall. In an embodiment where greater residence times are required to ensure an appropriate chemical treatment of the fluids, the openings through the inner tubular wall may be spaced greater distances from the openings through the outer tubular wall. For example in one embodiment, the openings through the inner tubular wall may be positioned adjacent one end of the wellbore tubular, while the openings through the outer tubular wall may be positioned adjacent the opposite end of the wellbore tubular, such that any fluid passing into or out of the tubular must flow along a considerable length of the tubular's wall in the chamber, while being acted upon by the chemical treatment materials therein. In such an embodiment, the length of the wellbore tubular, and thereby the length of the chamber in its wall, can then be selected to arrive at a desired residence time.

Alternately or in addition, the chamber between openings 4, 5 can include diverters that force fluid flow through a tortuous path, which thereby increases residence time over a straight through flow.

Of course, as with any wellbore tubular it may be necessary to consider any pressure drop created by flow through therethrough such that fluid flow into or out of the well is not adversely affected.

In use, a wellbore tubular, such as one of those described above, may be installed in a tubular string and run into a position in a wellbore. The wellbore tubular may then be in place to chemically treat fluids passing through the fluid passages of its perforated wall. The fluids may be passed from the wellbore through the fluid passages to flow to surface or the fluids may be introduced from the tubular into the wellbore. The fluid passages contain chemical treatment materials such that fluid flowing through the passages will be acted upon by the chemical treatment materials to be chemically modified. In use of a double walled embodiment, as described herein above, the fluids will pass through the openings of one of the inner or outer tubular walls, through chamber 3 containing the chemical treatment materials and then through the openings of the other of the inner or outer tubular walls. The fluid has a residence time in the chamber, which may be selected by placement and spacing of openings 4 relative to openings 5 and/or by creating a tortuous path between the openings.

The wellbore tubular including the chemical treatment materials may be placed in a selected position in the wellbore to treat the fluids at that location. Other regions of the well may also have tubulars for chemical treatment positioned therein, may have solid tubulars therein or may be left open without a tubular string positioned therein, as desired. As such, the chemical treatment materials can be placed specifically where the operator requires them.

During construction of the tubular, it is possible to suitably place a selected amount and composition of material 6 in the fluid passages of the tubular's wall to ensure that appropriate fluid treatment is provided for fluids passing through the tubular over a predictable period of time.

The tubular can be selected to provide chemical treatment of fluids passing therethrough and, by inclusion of filter media in openings 4, 5 and/or chamber 3, the tubular can be selected to further act as screen to mechanically treat fluids passing therethrough by screening out oversize materials from the fluid flow.

As noted previously, in use, it may be desirable to periodically regenerate the chemical treatment material, as by chemical flushing, gas purging and/or temperature, pressure or electromagnetic treatment regimes.

In use, the tubular may be used for any of the treatment processes described above, including in situ partial refining of wellbore produced fluids, water treatment and/or produced gas treatments.

In the illustrated embodiment, the tubular walls of the wellbore tubular are each formed of cartridge-type screens. Of course, although inner tubular wall 1 and outer tubular wall 2 are illustrated as cartridge-type screens, various constructions may be useful to form the wellbore tubular with a perforated wall and chamber that creates residence time for fluids passing therethrough. However, the use of cartridge-type screen tubulars offers a convenient construction and facilitates the relative spacing and positioning of the openings 4, 5.

Using outer tubular wall 2 as an example, a cartridge-type screen includes a base pipe 10 including substantially circular such as circular or ovoid openings 5 that extend from the base pipe inner bore surface 16 to the base pipe outer surface 2*a* and a filter cartridge 12 is supported in each opening. Such a screen is durable and is useful in various wellbores operations such as those for water production, water/steam injection, oil and/or gas production, etc. The filter cartridges permit fluid flow through the openings into or out of the base pipe.

Such cartridge-type screens are useful for constructing a wellbore tubular according to the present invention, as the locations of the openings may be selected with ease to distance the openings on one tubular wall, as desired, from the openings on the other tubular wall. The distance traveled by fluid through annular chamber 3 can be specifically selected by the relative positioning of the openings between the inner and outer tubular walls.

Various embodiments of such screens are described in detail herein after with reference to FIGS. 4 to 8.

Figure 4:
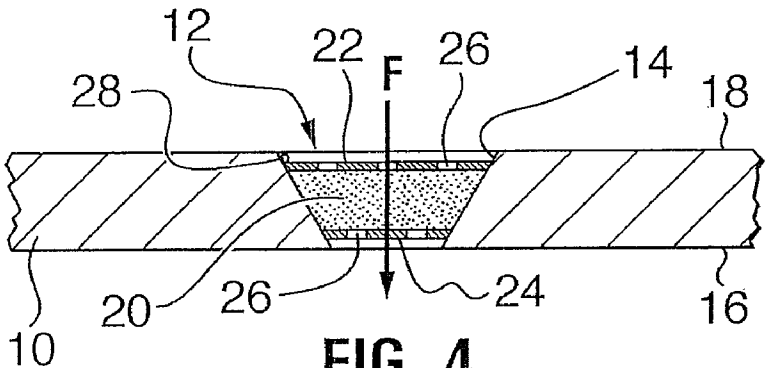
FIG. 4 is a section through a wellbore screen cartridge, with reference to line II-II of FIG. 1 for the sectional location thereof.

With reference to FIG. 4, for example, a filter cartridge 12 useful in a wellbore screen can include a filter media 20. In one embodiment, the filter cartridge can also include one or more retainer plates positioned about the filter media. In one embodiment, as illustrated, the filter cartridge includes an exterior retainer plate 22, an interior retainer plate 24 and filter media 20 contained therebetween. In one embodiment, the exterior retainer plate and the interior retainer plate may be coupled to one another by any of a plurality of methods, such as adhesives, welding, screws, bolts, plastic deformation and so on. In another embodiment, the retainer plates are not secured together but held in position by their mounting in the base pipe.

If used, the exterior retainer plate and the interior retainer plate may contain one or more apertures 26 through which fluid may flow, arrow F. Exterior retainer plate 22 and interior retainer plate 24 may be constructed of any suitable material, such as plastic, aluminum, steel, ceramic, and so on, with consideration as to the conditions in which they must operate.

Filter media 20 of the filter cartridge can be any media, such as including a layer of compressed fiber, woven media, ceramic and/or sinter disk that is capable of operating in wellbore conditions. The filter media must be permeable to selected fluids such as one or more of steam, stimulation fluids, oil and/or gas, while able to exclude oversized solid matter, such as sediments, sand or rock particles. Of course, certain solids may be permitted to pass, as they do not present a difficulty to the wellbore operation. Filter media can be selected to exclude particles greater than a selected size, as desired. The present screen can employ one or more layers or types of filter media. In one embodiment, a filter media including an inner woven screen, an outer woven screen and a fibrous material is used. In another embodiment, a filter cartridge may include a single layer of filter media, as shown in FIG. 4, to facilitate manufacture. Sintered material may be useful as a single layer filter media.

Openings 14 may be spaced apart on the base pipe wall such that there are chambers of solid wall therebetween. The openings extend through the base pipe sidewall and may each be capable of accommodating a filter cartridge 12. The filter cartridges can be mounted in the openings by various methods including welding, threading, etc. In one embodiment, at least some filter cartridges may be installed by taper lock fit into the openings. In such an embodiment, each of the filter cartridge and the opening into which it is to be installed may be substantially oppositely tapered along their depth so that a taper lock fit can be achieved. For example, the effective diameter of the opening adjacent the base pipe's outer surface 18 may be greater than the effective diameter of the opening adjacent inner bore surface 16 and cartridge 12 inner end effective diameter, as would be measured across plate 24 in the illustrated embodiment, may be less than the effective diameter at the outer end of filter cartridge 12 and greater than the opening effective diameter adjacent inner bore surface 16, so that the filter cartridge may be urged into a taper lock arrangement in the opening. In particular, the outer diameter of the filter cartridge can be tapered to form a frustoconical (as shown), frustopyramidal, etc. shape and this can be fit into the opening, which is reversibly and substantially correspondingly shaped to engage the filter cartridge when it is fit therein. In one embodiment for example, the exterior retainer plate may exceed the diameter of the interior retainer plate of the filter cartridge. Of course, the filter cartridge may be tapered from its inner surface to its outer surface in a configuration that is frustoconical, frustopyramidal, and so on and the openings of the base pipe may be tapered correspondingly so that their diameter adjacent the inner bore surface is greater than that adjacent the side wall outer surface, if desired. However, installation may be facilitated by use of an inwardly directed taper, as this permits the filter cartridges to be installed from the base pipe outer surface and forced inwardly.

The filter cartridges may be secured in the base pipe openings by any of various means. For example, in one embodiment, the filter cartridge may be press-fit into the opening of the base pipe. In another embodiment, the filter cartridge may be secured to the opening of the base pipe by an adhesive 28 (for example epoxy), by welding, by soldering, by plastic deformation of the base pipe over the cartridge, by holding or forcing the cartridge into engagement behind a retainer or extension over of the opening and so on, at one or more of the interface points between the filter cartridge and the base pipe. A seal, such as an o-ring, may be provided between the filter cartridge and the opening, if desired.

Figure 5:
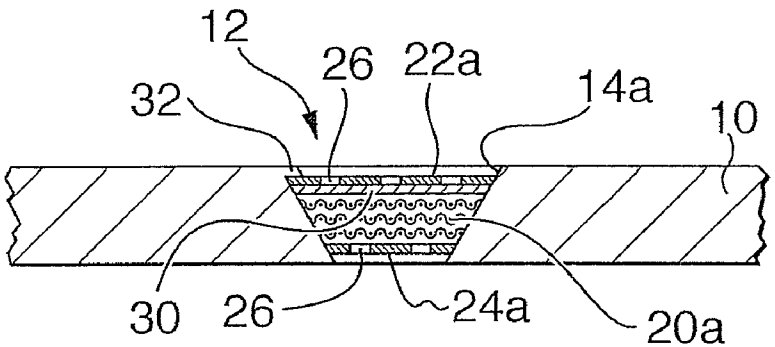
FIG. 5 is a section through another wellbore screen cartridge, the sectional position corresponding to that of FIG. 4.

In a further embodiment as shown in FIG. 5, a wellbore screen may include a selectively openable impermeable layer 30 relative to at least some of the plurality of openings, such as illustrated by opening 14*a*. The impermeable layer can be normally closed and when closed is impermeable to solid matter as well as substantially impermeable to fluid flow, such as any or all of wellbore fluids, drilling fluids, injection fluids, etc. Impermeable layer 30, however, can be selectively opened, as by removal, bursting, etc. of the impermeable layer at a selected time, such as when the screen is in a selected position downhole, such as when it is in a finally installed position.

The impermeable layer may act at one or a plurality of openings to plug fluid flow therethrough. For example, the screen can include an inner or an outer covering on its sidewall that covers a plurality of openings. Alternately or in addition, an impermeable layer can be applied to or incorporated in the filter cartridges. In one embodiment, impermeable layer 30 may be applied on or adjacent exterior and/or interior filter cartridge retainer plates 22*a*, 24*a* or can be incorporated into the filter cartridges, as for example by infiltration into filter media 20*a*. It may be useful to position the impermeable layer such that it is protected against direct contact or to facilitate manufacture. In one embodiment, the impermeable layer can be protected within components of the filter cartridge, as shown. The impermeable layer may serve to cover/block/plug the openings and the filter cartridge in order to prevent the flow of fluid therethrough and/or to prevent access of solids to the filter media, until the impermeable layers are selectively opened.

The impermeable layer may comprise various materials, such as aluminum foil, glass, wax, cellulose, polymers, and so on. The impermeable layer may be opened to permit fluid flow, as by removal or breaking, once the wellbore screen is in position down hole. The method of opening can vary based on the material of the impermeable layer, and may include pressure bursting, impact destruction, and/or removal by solubilization, melting, etc. as by acid, caustic or solvent circulation, temperature sensitive degradation, and so on.

In one application, a wellbore screen including impermeable layers relative to its openings, may be useful to resist plugging of the openings, which can result for example from the rigors of running in. In another application, the impermeable layers are used to selectively allow flow along or from a certain section of the wellbore, while flow is blocked through other openings. In yet another application, a wellbore screen including impermeable layers relative to its openings, may be useful to permit drilling of the screen into the hole, as by liner or casing drilling. In such an application, the impermeable layers can be selected to hold the pressures encountered during drilling, for example, pressures of a couple of hundred psi. In such an embodiment, the impermeable layers will be present to plug the openings at least when the wellbore screen is being run down hole so that the wellbore screen may be drilled directly into the hole. Once the screen is drilled into position, the impermeable layers may be opened, as by bursting with application of fluid pressure above that which the layers can hold.

Depending on the application, it may be useful to seal all of the openings of a wellbore screen or it may be useful to block only certain of the openings, while others are left open. In another embodiment, it may be useful to use selected materials to form the impermeable layers on a first group of openings while another impermeable layer material is used over the openings of a second group so that some openings within a liner, for example those of the first group, can be opened while others, for example the openings of the second group, remain closed until it is desired to remove or break open that impermeable material.

One or more impermeable layers can be used, as desired. The layers may be positioned to provide protection to certain filter cartridge components. For example, where media plugging is a concern the impermeable layer can be positioned to protect against plugging such as by positioning the impermeable layer adjacent exterior retainer plate 22*a* to protect against plugging by external flows or materials. Alternately or in addition, an impermeable layer may be provided between inner retainer plate and the filter media to prevent plugging by flow from inside to outside.

In the illustrated embodiment of FIG. 5, impermeable layer 30 is positioned between exterior retainer plate 22*a* and filter media 20*a* to prevent plugging of the filter media by scraping along the wellbore during run in and by external fluid flows.

It is noted that FIG. 5 also illustrates an embodiment wherein plastic deformation has been used to form a material extension 32 from the base pipe that overlies the outer surface of the filter cartridge to secure the cartridge in opening 14*a*. It is also noted that a filter media 20*a* of multiple layered, woven materials is illustrated.

Figure 6:
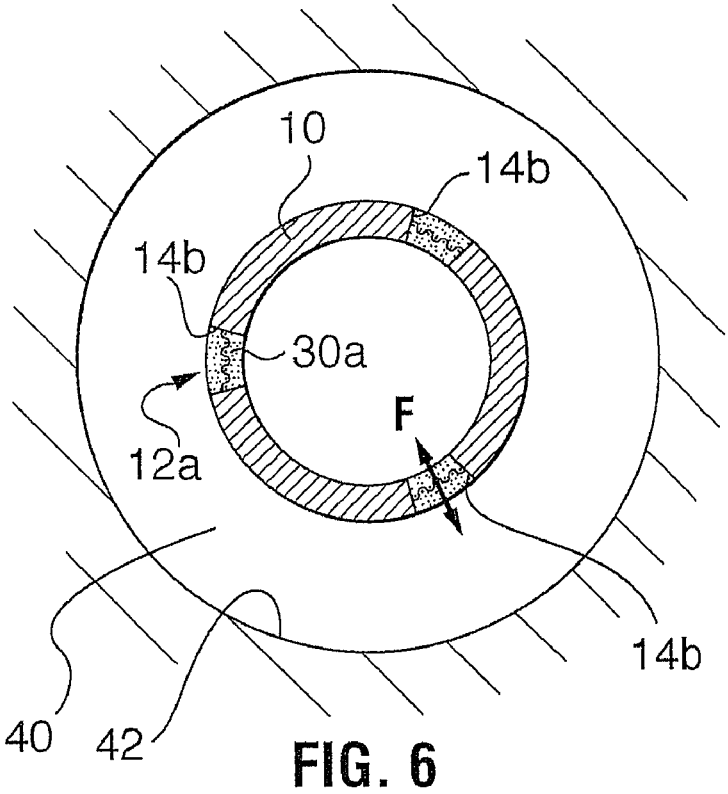
FIG. 6 is a section through another wellbore screen cartridge, the sectional position corresponding to that of FIG. 4.

A wellbore screen, as illustrated in FIG. 6, that is selectively closeable may also be useful where it would be beneficial to run in and/or operate the wellbore screen having open filter cartridges 12*a*, which are later intended to be closed. Such closing may be provided by an impermeable layer associated with the openings of the base pipe 10, the layer being selected to close by a trigger such as for example a chemical such as water or a catalyst, etc. pumped into the well to contact the layer, temperature changes, etc. In one embodiment, an impermeable layer 30*a* may be provided by a chemical agent in a filter cartridge 12*a*. The chemical agent impermeable layer, when it has not yet been triggered, permits fluid flow F through the openings 14*b* in which the filter cartridges and the layer are mounted. However, the impermeable layer of chemical agent acts, when triggered by contact with water, to swell and plug its filter cartridge and opening, for example, by plugging the pores of the filter media.

Figure 7:
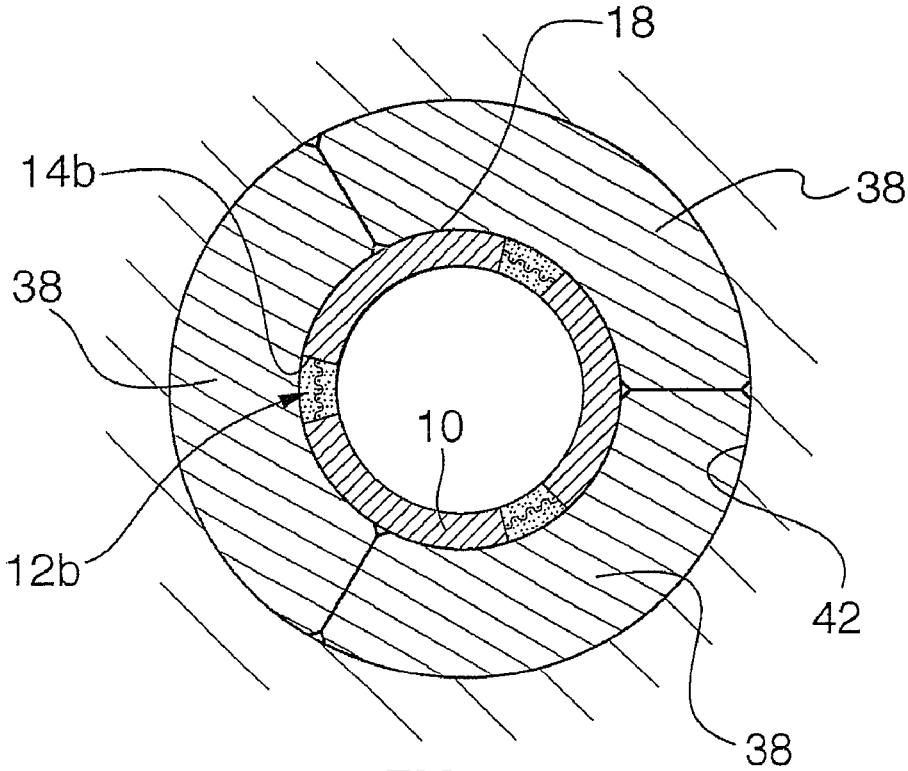
FIG. 7 is an axial section through a wellbore screen.

In another embodiment illustrated in FIG. 7, an impermeable layer associated with the openings, may be selected such that it is normally open but, when triggered, it is capable of swelling to generate impermeable layer material 38 at least beyond the outer surface 18 of the wellbore screen and possibly in the inner bore of the base pipe 10, as well. Sufficient impermeable layer material 38 may be generated during swelling such that the annulus 40 between the screen and the borehole wall 42 may be plugged, thereby preventing flow along the annulus. One application where this would be beneficial is in water shut off operations in uncemented horizontal or vertical wells. In such an application, a liner may be used with wellbore screens installed therein and at intervals along the liner and screens position wellbore screen joints with water shut off cartridges. When triggered the impermeable layer material in the cartridges may swell out of the openings 14*b* to plug the annulus. The plug may prevent the production of water or fluids therepast.

Figure 8:
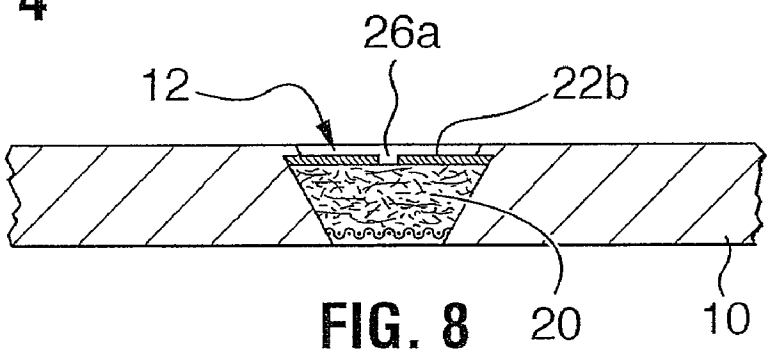
FIG. 8 is a section through another wellbore screen.

With reference to FIG. 8 another embodiment is shown wherein filter cartridge 12*b* is formed to act as a nozzle, as by providing a nozzle component such as for example aperture 26*a* in a retainer plate 22*b*, and includes filter media 20*b*. As such, filter cartridge 12*b* can act to provide sand control and can also have the necessary characteristics to act as a nozzle to vaporize, atomize or jet fluid flow to select injection characteristics. Thus, any fluids introduced through the screen can be shaped or treated to improve contact with the reservoir. In another embodiment, the opening may be formed to act as a nozzle and the filter cartridge may be positioned therein.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. For US patent properties, it is noted that no claim element is to be construed under the provisions of 35 USC 112, sixth paragraph, unless the element is expressly recited using the phrase "means for" or "step for".

I claim:

1. A wellbore tubular comprising: a perforated wall including an inner tubular wall, an opening through the inner tubular wall, an outer tubular wall positioned about the inner tubular wall, an opening through the outer tubular wall, and a chamber between the inner tubular wall and the outer tubular wall, a fluid flow path being set up through the chamber along the shortest distance between the opening of the inner tubular wall and the opening of the outer tubular wall; and a chemical treatment material in the chamber and positioned between the opening of the inner tubular wall and the opening of the outer tubular wall in the fluid flow path.

2. The wellbore tubular of claim 1 wherein the opening of the inner tubular wall is offset both axially and radially from the opening of the outer tubular wall.

3. The wellbore tubular claim 1 wherein the opening of the outer tubular wall includes filter media therein.

4. The wellbore tubular of claim 1 wherein the chemical treatment material is selected to chemically modify a fluid to be flowed therethrough.

5. The wellbore tubular of claim 1 wherein the chemical treatment material includes one or more of a catalyst, an absorbent, an adsorbent, a solubilizable chemical and an active metal.

6. The wellbore tubular of claim 1 wherein the chemical treatment material includes a catalyst for in-situ partial refining of petroleum production fluids.

7. The wellbore tubular of claim 1 wherein the chemical treatment material includes a material for the treatment of produced gas to remove a component therefrom.

8. The wellbore tubular of claim 1 wherein the chemical treatment material includes a water treatment material.

9. The wellbore tubular of claim 1 wherein the chemical treatment material includes a catalyst that is enhanced by elevated temperatures generated by the in-situ production processes.

10. The wellbore tubular of claim 1 wherein the chemical treatment material is distributed along the fluid flow path.

11. The wellbore tubular of claim 1 wherein the chemical treatment material is distributed along an entire length the fluid flow path.

12. The wellbore tubular of claim 1 wherein the chemical treatment material fills the fluid flow path.

13. The wellbore tubular of claim 1 wherein the chamber is an annular opening between the inner tubular wall and the outer tubular wall and the chamber is filled with the chemical treatment material.

14. A method for treatment of a fluid in a well, the method comprising: running a wellbore tubular into a wellbore in a heavy oil producing formation undergoing at least one of steam-assisted, vapor-assisted or combustion in-situ production processing, the wellbore tubular including a fluid passage through a wall thereof and carrying a chemical treatment material in the fluid passage, the chemical treatment material selected to at least partially refine heavy oil; and allowing a flow of a fluid including heavy oil through the fluid passage and into active contact with the chemical treatment material, such that the heavy oil is at least partially refined by the chemical treatment material.

15. The method for treatment of a fluid in a well of claim 14 wherein the wellbore tubular further includes filter media in the fluid passage to screen oversize materials and wherein allowing the flow of the fluid includes passing the flow through the filter media to screen oversize materials from the flow.

16. The method for treatment of a fluid in a well of claim 14 further comprising regenerating the chemical treatment material while the wellbore tubular remains in place in the wellbore.

17. The method for treatment of a fluid in a well of claim 14 further comprising selecting the fluid passage length to control the residence time of the fluid in the fluid passage.

18. The method for treatment of a fluid in a well of claim 14 wherein the chemical treatment material acts to crack the heavy oil.

19. The method for treatment of a fluid in a well of claim 18 wherein the chemical treatment material cracks the heavy oil by at least one of hydrogenation, carbon rejection or carbon concentration and removal.

20. The method for treatment of a fluid in a well of claim 14 wherein the chemical treatment material is a petrochemical upgrading catalyst.

21. The method for treatment of a fluid in a well of claim 20 wherein the petrochemical upgrading catalyst is selected from the group consisting of hydrotreating catalyst, CoMo catalyst and CoMo/Al catalyst .

22. The method for treatment of a fluid in a well of claim 20 wherein the petrochemical upgrading catalyst includes an element selected from the group consisting of Rd, Pt, Pd, Cr and rare earths.

23. A wellbore tubular comprising: a perforated wall including an inner tubular wall, an opening through the inner tubular wall, an outer tubular wall positioned about the inner tubular wall, an opening through the outer tubular wall, and a chamber between the inner tubular wall and the outer tubular wall; and a chemical treatment material in the chamber and positioned between the opening of the inner tubular wall and the opening of the outer tubular wall, the chemical treatment material selected to at least partially refine heavy oil from at least one of steam-assisted, vapor-assisted or combustion in-situ production processes.

24. The wellbore tubular of claim 23 wherein the chemical treatment material includes a catalyst that is enhanced by elevated temperatures generated by the in-situ production processes.

25. The wellbore tubular of claim 23 wherein the chemical treatment material acts to crack the heavy oil.

26. The wellbore tubular of claim 25 wherein the chemical treatment material cracks the heavy oil by at least one of hydrogenation, carbon rejection or carbon concentration and removal.

27. The wellbore tubular of claim 23 wherein the chemical treatment material is a petrochemical upgrading catalyst.

28. The wellbore tubular of claim 27 wherein the petrochemical upgrading catalyst is selected from the group consisting of hydrotreating catalyst, CoMo catalyst and CoMo/Al catalyst.

29. The wellbore tubular of claim 27 wherein the petrochemical upgrading catalyst includes an element selected from the group consisting of Rd, Pt, Pd, Cr and rare earths.

30. A wellbore tubular comprising: a perforated wall including an inner tubular wall, an opening through the inner tubular wall, a filter media installed in the opening through the inner tubular wall, an outer tubular wall positioned about the inner tubular wall, an opening through the outer tubular wall, and filter media installed in the opening through the outer tubular wall; and a chemical treatment material positioned in a space between the filter media of the opening of the inner tubular wall and the filter media of the opening of the outer tubular wall.

31. The wellbore tubular of claim 30 wherein the openings are circular or ovoid in plan view.

32. The wellbore tubular of claim 30 wherein the opening of the inner tubular wall is offset radially from the opening of the outer tubular wall.

33. The wellbore tubular of claim 30 further comprising further openings through the inner tubular wall, each with filter media installed therein and further comprising further openings through the outer tubular wall, each with filter media installed therein and the openings through the inner tubular wall being offset radially from the openings of the outer tubular wall.

34. The wellbore tubular of claim 30 further comprising further openings through the inner tubular wall, each with filter media installed therein and further comprising further openings through the outer tubular wall, each with filter media installed therein and the openings through the inner tubular wall being offset axially along the tubular from the openings of the outer tubular wall.

35. The wellbore tubular of claim 30 wherein the chemical treatment material is selected to chemically modify a fluid to be flowed therethrough.

36. The wellbore tubular of claim 30 wherein the chemical treatment material includes one or more of a catalyst, an absorbent, an adsorbent, a solubilizable chemical and an active metal.

37. The wellbore tubular of claim 30 wherein the chemical treatment material includes a catalyst for in-situ partial refining of petroleum production fluids.

38. The wellbore tubular of claim 30 wherein the chemical treatment material includes a material for the treatment of produced gas to remove a component therefrom.

39. The wellbore tubular of claim 30 wherein the chemical treatment material includes a water treatment material.

* * * * *